US006790060B1

(12) United States Patent
Chiang

(10) Patent No.: US 6,790,060 B1
(45) Date of Patent: Sep. 14, 2004

(54) STORING LID FOR ELECTRONIC DEVICES

(75) Inventor: Thomas Chiang, Taipei (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 51 days.

(21) Appl. No.: 10/377,734

(22) Filed: Mar. 4, 2003

(30) Foreign Application Priority Data

Dec. 24, 2002 (TW) ..... 091221027

(51) Int. Cl.[7] ..... H01R 13/44
(52) U.S. Cl. ..... 439/142; 439/136
(58) Field of Search ..... 439/135, 136, 439/142; 174/59, 67

(56) References Cited

U.S. PATENT DOCUMENTS 4,478,005 A * 10/1984 Mundschenk ..... 49/388
5,050,211 A * 9/1991 Dortu et al. ..... 379/438
5,124,506 A * 6/1992 Briggs et al. ..... 174/67
5,148,348 A * 9/1992 White ..... 361/658
5,199,888 A * 4/1993 Condra et al. ..... 439/142
5,224,869 A * 7/1993 Lee ..... 439/136
5,306,178 A * 4/1994 Huang ..... 439/536
5,331,506 A * 7/1994 Nakajima ..... 361/683
5,379,183 A * 1/1995 Okonsky et al. ..... 361/681
5,534,888 A * 7/1996 Lebby et al. ..... 345/672
5,574,625 A * 11/1996 Ohgami et al. ..... 361/684
5,701,232 A * 12/1997 Tang et al. ..... 361/683
5,724,226 A * 3/1998 Ruch et al. ..... 361/683
5,738,536 A * 4/1998 Ohgami et al. ..... 439/142
5,754,397 A * 5/1998 Howell et al. ..... 361/686
5,769,646 A * 6/1998 Cavello et al. ..... 439/136
5,808,861 A * 9/1998 Nakajima et al. ..... 361/680
5,815,379 A * 9/1998 Mundt ..... 361/683
5,848,719 A * 12/1998 Goldenberg ..... 220/326
5,924,782 A * 7/1999 Park ..... 312/328
5,936,214 A * 8/1999 Phillips ..... 200/43.22
5,963,422 A * 10/1999 Golobay et al. ..... 361/686
5,964,599 A * 10/1999 Choi ..... 439/135
5,980,279 A * 11/1999 Muller ..... 439/142
6,038,125 A * 3/2000 Anzai ..... 361/609
6,125,031 A * 9/2000 Della Fiora et al. ..... 361/683
6,198,626 B1 * 3/2001 Nakajima et al. ..... 361/686
6,208,509 B1 * 3/2001 Cha ..... 361/686
6,219,226 B1 * 4/2001 Bullington et al. ..... 361/683
6,229,418 B1 * 5/2001 Mueller et al. ..... 335/202
6,267,608 B1 * 7/2001 Yagi ..... 439/142
6,305,956 B1 * 10/2001 Deng ..... 439/138
6,314,483 B1 * 11/2001 Goto et al. ..... 710/107
6,375,480 B1 * 4/2002 Chen et al. ..... 439/142
6,406,321 B1 * 6/2002 Hayashi et al. ..... 439/374
6,442,637 B1 * 8/2002 Hawkins et al. ..... 710/300
6,454,581 B1 * 9/2002 Ribeiro ..... 439/148
6,512,178 B2 * 1/2003 Goodman ..... 174/66
6,519,142 B1 * 2/2003 Lai et al. ..... 361/683
6,652,297 B1 * 11/2003 Zhang et al. ..... 439/136
6,661,650 B2 * 12/2003 Nakajima et al. ..... 361/683
6,674,639 B2 * 1/2004 Wang et al. ..... 361/683
6,679,710 B2 * 1/2004 Saito et al. ..... 439/142
6,690,579 B1 * 2/2004 Ribeiro ..... 361/728
6,737,577 B1 * 5/2004 Liao et al. ..... 174/50

* cited by examiner

*Primary Examiner*—Ross Gushi
(74) *Attorney, Agent, or Firm*—Birch, Stewart, Kolasch & Birch, LLP

(57) ABSTRACT

A storing lid to cover a signal transmission port of an electronic device includes a housing and a lid. The housing has an opening corresponding to the signal transmission port. The lid is movably located on the housing, and may be located on a first position when the signal transmission port is not in use to cover the opening and prevent dust or external objects from entering into the port. The lid is moved to a second position when the signal transmission port is in use so that the lid may be stored on one side of the opening without being lost.

7 Claims, 5 Drawing Sheets

STORING LID FOR ELECTRONIC DEVICES

FIELD OF THE INVENTION

The invention relates to a storing lid for covering a signal transmission port of an electronic device, and particularly to a storing lid structure that prevents contamination of the signal transmission port by fending off dust or external objects when not in use, and that may be stored in the housing of the electronic device when the signal transmission port is in use.

BACKGROUND OF THE INVENTION

Many electronic devices have signal transmission ports to connect external cables and transmit data to other electronic devices. The housing of the electronic devices must have openings corresponding to the signal transmission ports to facilitate external connection. However before the electronic devices are connected, the signal transmission ports are exposed and often contaminated by dust or external objects. This could result in a poor connection or even dysfunction of the signal transmission port.

Recently, a movable lid to cover the opening of the housing of the electronic devices has been designed. The lid may cover the opening when the electronic device is not connected externally, and can prevent the signal transmission port from being contaminated by dust or external objects. When the electronic device is connected, the lid is removed and stored in another location. However, such a design and arrangement often results in loss of the lid.

SUMMARY OF THE INVENTION

In view of the aforesaid disadvantages, the primary object of the invention is to provide a storing lid for electronic devices so that the signal transmission port may be covered when not in use to prevent contamination from dust or external objects, and be opened when in use and stored at a selected location without being lost.

The storing lid for electronic devices of the invention aims to cover the signal transmission port. It includes a housing and a lid. The housing has an opening corresponding to the signal transmission port of the electronic device. The lid is movably located on the housing, and has a first position and a second position. When the signal transmission port is not in use, the lid is at the first position to cover the opening and prevent contamination from dust or external objects. When the signal transmission port is in use, the lid is at the second position and stored on one side of the opening to avoid being lost.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
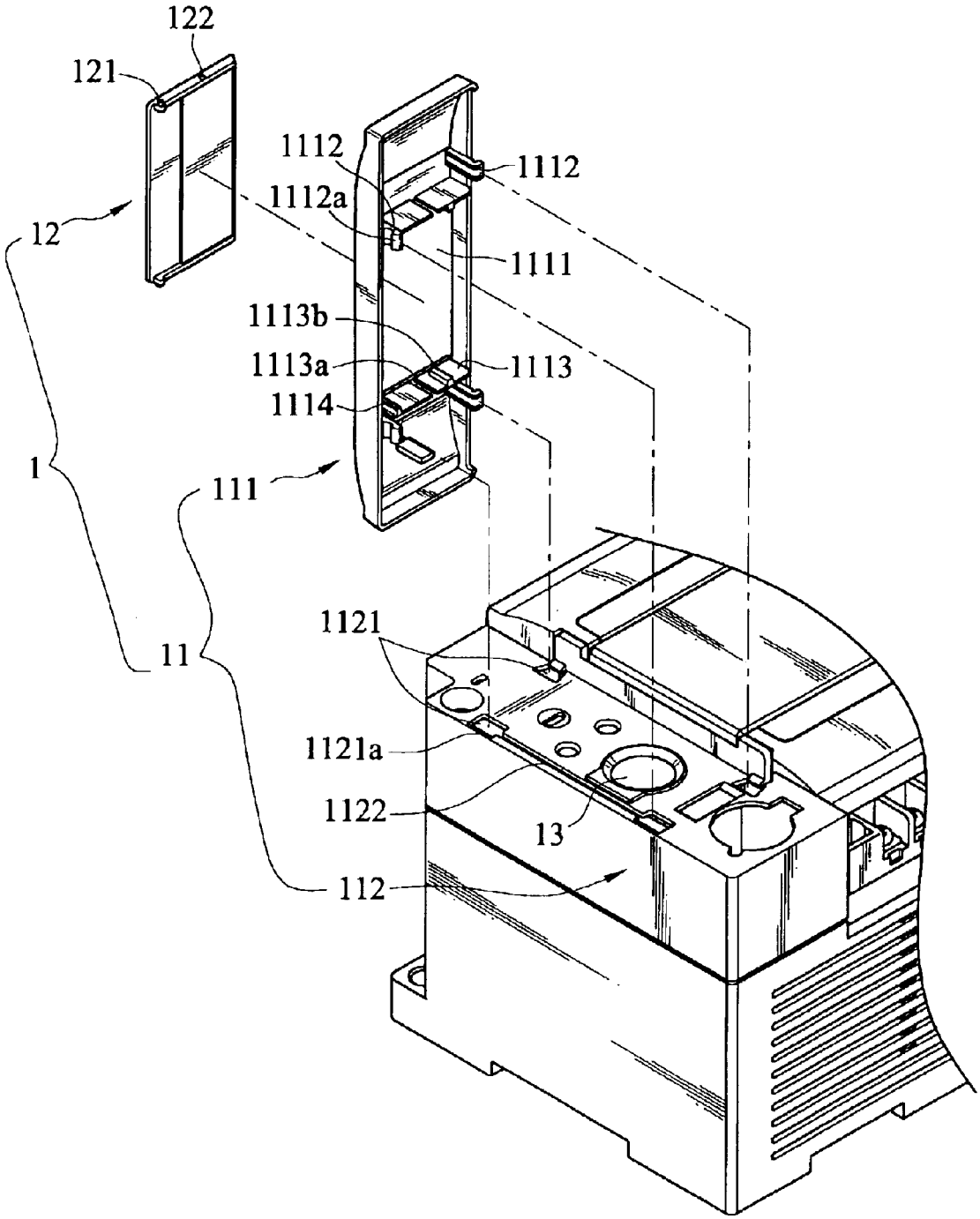
FIG. 1 is an exploded view of the invention.
Figure 2:
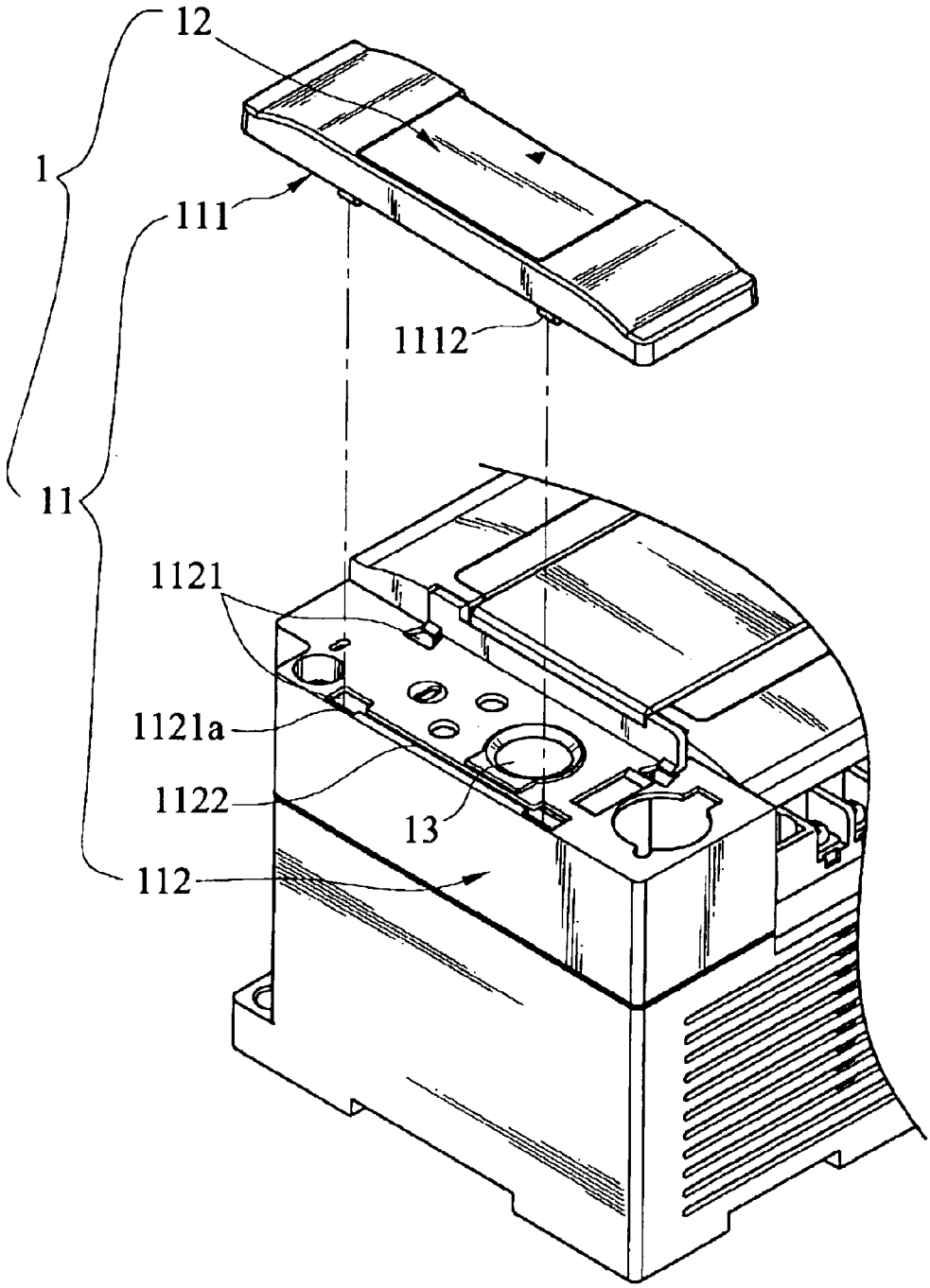
FIG. 2 is a schematic view of the invention with the lid mounted onto the cover.
Figure 3:
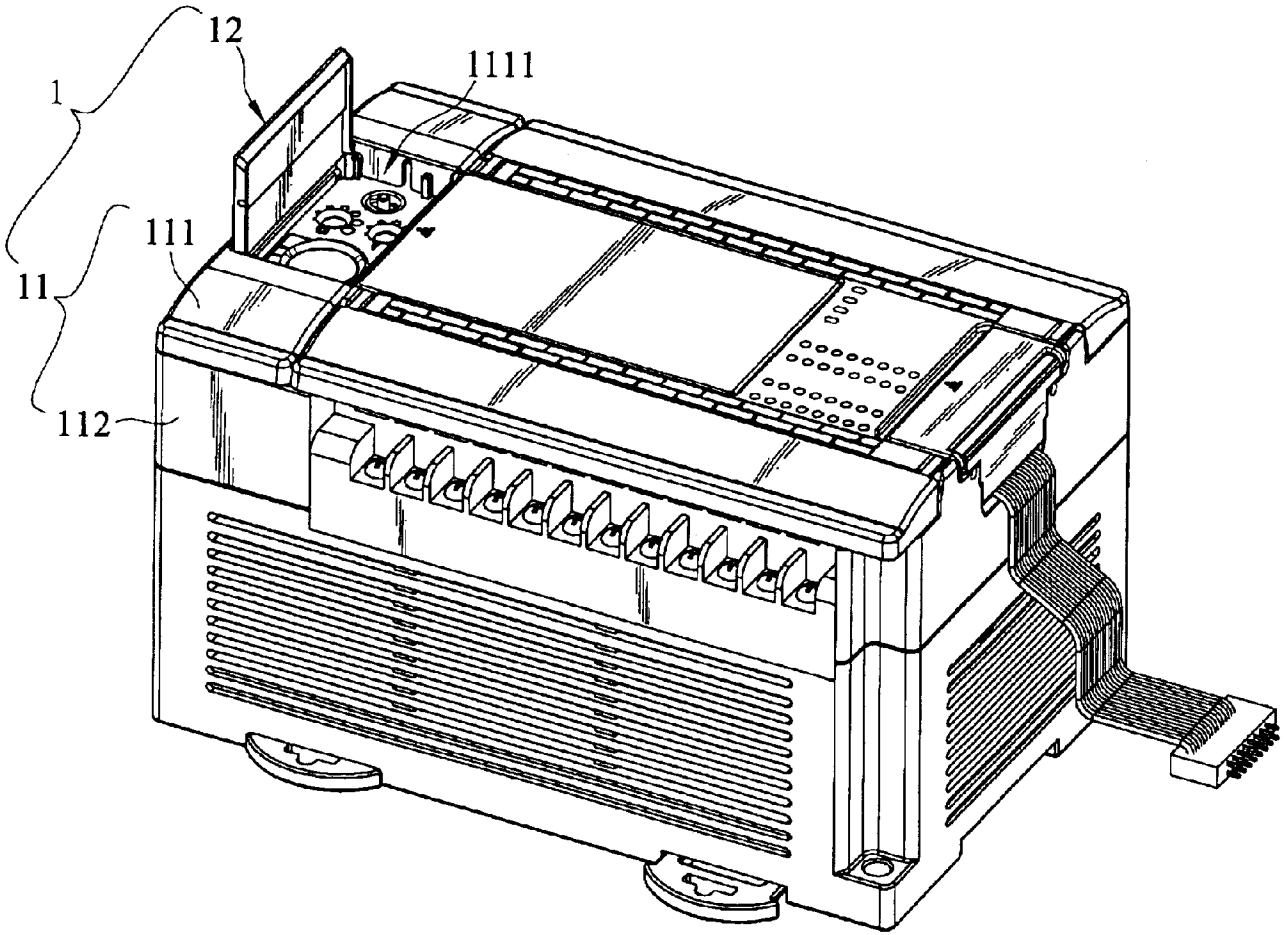
FIG. 3 is a schematic view of the invention with the lid mounted onto the cover and the cover mounted onto the casing, and the lid being pivotally turned to the edge of the slot opening.
Figure 4A:
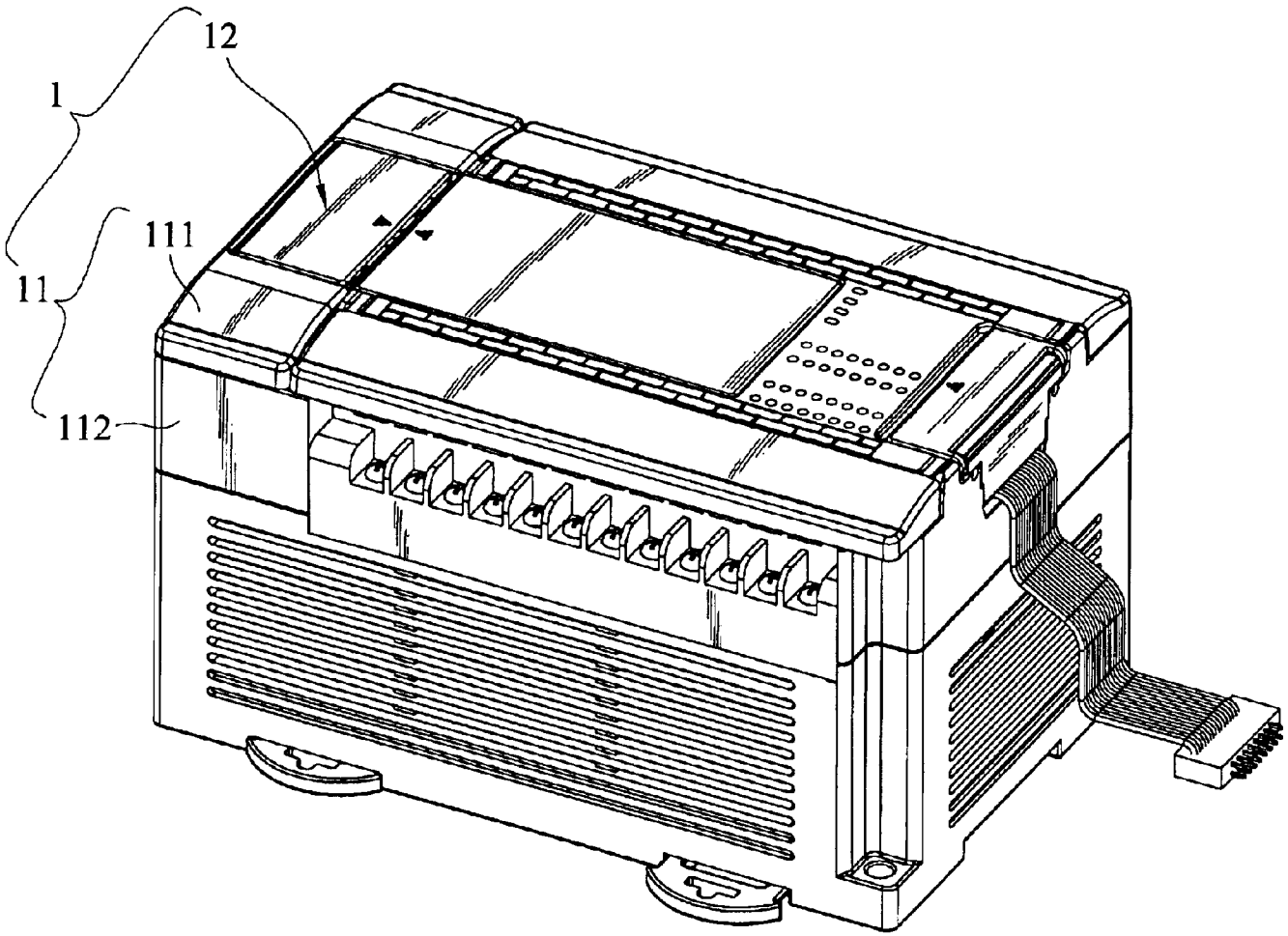
FIGS. 4A and 4B are schematic views of the invention at the first and the second positions.
Figure 4B:
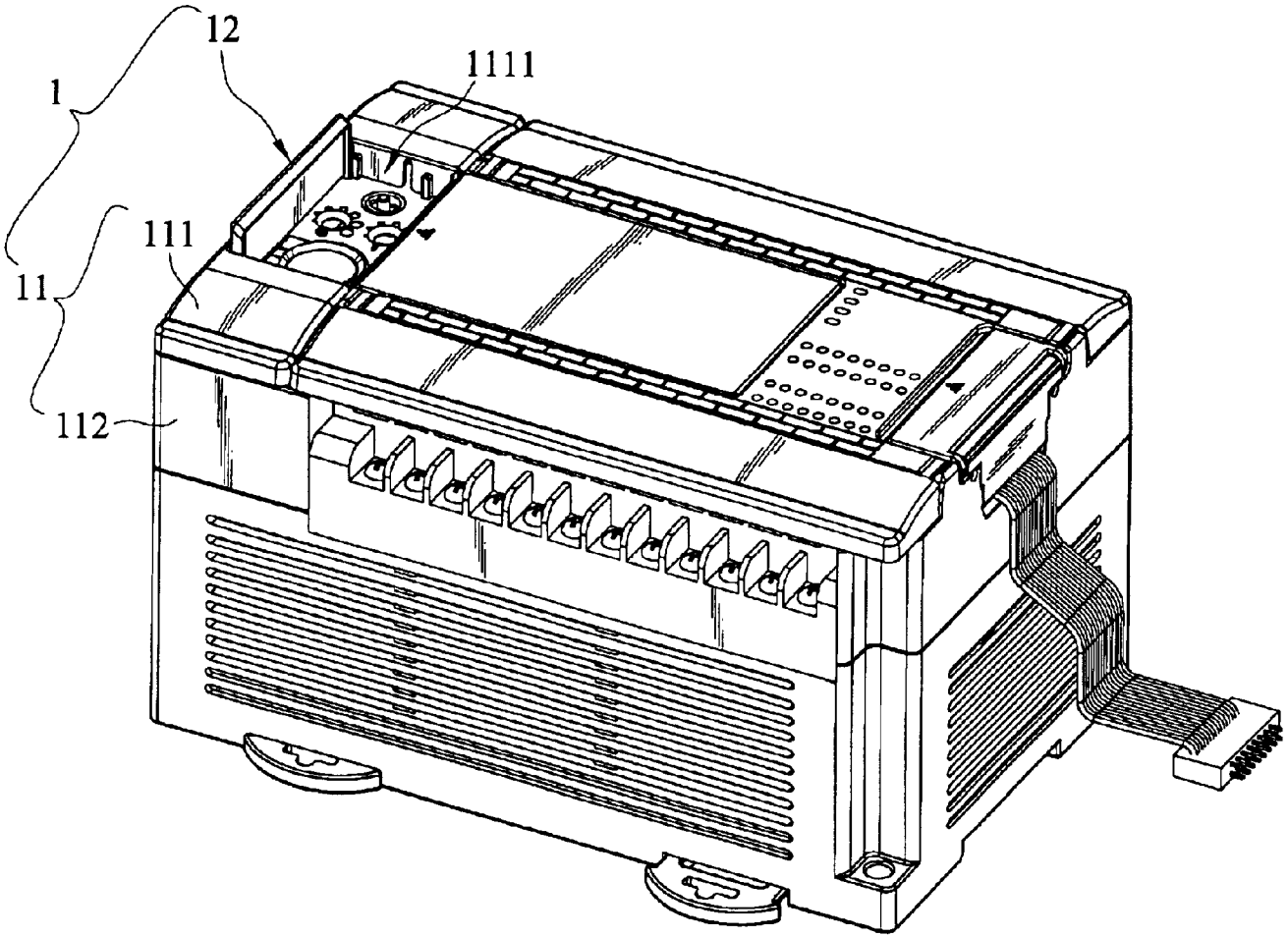

Referring to FIGS. 1 through 4B, the storing lid of the invention aims to cover a signal transmission port 13 of an electronic device 1. The invention includes a housing 11 and a lid 12 of the electronic device 1. The housing 11 consists of a cover 111 and a casing 112 on which the cover 111 is mounted.

The cover 111 has an opening 1111, hooks 1112, extension plates 1113 and a guiding channel 1114. The opening 1111 corresponds to the signal transmission port 13 of the electronic device 1. The hooks 1112 are located on the bottom section of the cover 111, each with a guiding edge 1112*a*. The extension plates 1113 are located on the bottom section of the cover 111 and extend downwards from the opening 1111. Each extension plate 1113 further has a latch slot 1113*a* and a strut 1113*b*. The guiding channel 1114 is located between the extension plate 1113 and the inner wall of the cover 111.

The casing 112 has holes 1121 and a slot opening 1122. The holes 1121 are formed on the top section of the casing 112 corresponding to the hooks 1112. Each hole 1121 has a sloped surface 1121 a at one end corresponding to the guiding edge 1112*a* to enable the guiding edge 1112*a* to slide thereon and go into the hole 1121 so that the cover 111 may be movably mounted onto the casing 112 with the slot opening 1122 corresponding to the lid 12.

The lid 12 is movably mounted onto the cover 111, and has a first position and a second position. When the signal transmission port 13 is not in use, the lid 12 may cover the opening 1111 at the first position to prevent dust or external objects from entering into the port. When the signal transmission port 13 is in use, the lid 12 may be stored on one side of the slot opening 1111 without being lost. The lid 12 has stub shafts 121 and bulged spots 122. The stub shafts 121 are located on the bottom end of the lid 12 corresponding to the guiding channel 114. Thus the guiding channel 1114 can guide the movement of the lid 12. Moreover, the stub shafts 121 may be moved to one distal end of the guiding channel 14 and pivotally turned thereon to allow the lid 12 to be pivotally engaged with the cover 111. The bulged spots 122 are located on two opposite sides of the lid 12. When the lid 12 is moved in the guiding channel 1114 towards the casing 112, the lid 12 is housed in the slot opening 1122 until the bulged spot 122 bucks the distal end of the guiding channel 1114. Because of the restriction of the bulged spot 122, the lid 12 may be housed in the slot opening 1122 securely at the second position without wobbling. When the lid 12 is located at the first position, the bulged spot 122 is wedged in the latch slot 1113*a*, and the strut 1113*b* limits the turning angle of the lid 12. Thus the lid 12 may be securely mounted onto the first position without wobbling.

For assembly of the invention, first, dispose the lid 12 in the guiding channel 1114 with the bulged spots 122 of the lid 12 passing over the distal end of the guiding channel 1114 until the stub shafts 121 of the lid 12 buck the distal end of the guiding channel 1114. This allows the lid 12 to be movably mounted onto the cover 111. Next, insert the hooks 1112 of the cover 111 into the holes 1121 of the casing 112. Apply force to the cover 111 to make the guiding edge 1112*a* of the hook 1112 slide over the sloped surface 1121 a and slip into the holes 1121 to complete the assembly of the invention.

When moving the lid 12 from the first position to the second position for using the signal transmission port 13, first, move the bulged spots 122 of the lid 12 away from the latch slot 1113*a* to allow the stub shafts 121 of the lid 12 to be pivotally turnable at the distal end of the guiding channel 1114. Then push the lid 12 into the casing 112 with the bulged spot 122 moving in the guiding slot 1114 until the lid 12 is housed in the slot opening 1122 and the bulged spot 122 reaches the distal end of the guiding channel 1114. The lid 12 is thus securely located oil the second position without wobbling. Then the cable may be connected to the signal transmission port 13 without being affected by the lid 12. On the other hand, when moving the lid 12 from the second position to the first position to cover the opening 1111 of the cover 111 and prevent the signal transmission port 13 from being contaminated, first, move the bulged spot 122 from the distal end of the guiding channel 1114 and draw the lid 12 from the slot opening 1122. The stub shafts 121 are located on the distal end of the guiding channel 1114. The lid may be turned pivotally to latch the bulged spot 122 on the latch slot 1113*a*. With the restriction of the strut 1113*b*, the lid 12 may be turned to a selected angle (first position) and securely mounted on the first position without wobbling.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A storing lid for electronic devices to cover a signal transmission port of an electronic device, comprising:

a housing of the electronic device having a cover, a casing for supporting the cover, and an opening corresponding to the signal transmission port, the cover having two extension plates extended from a bottom section thereof corresponding to each other and a guiding channel located between each extension plate and an inner wall of the cover; and a lid having a stub shaft located on a bottom end corresponding to the guiding channel to guide the lid moving in the guiding channel until the stub shaft reaching a distal end of the guiding channel so that the lid is pivotally engaged with the cover, the lid being located on a first position when the signal transmission port is not in use to cover the opening to prevent dust or external objects from entering into the signal transmission port, and on a second position when the signal transmission port is in use with the lid housed on one side of the opening without lost.

2. The storing lid for electronic devices of claim 1, wherein the cover has a plurality of hooks located on a bottom section thereof, the casing having a plurality of holes formed on a top section corresponding to the hooks to allow the cover movably mounted onto the casing.

3. The storing lid for electronic devices of claim 2, wherein each of the hooks has a guiding edge, each of the holes having a sloped surface on one end thereof corresponding to the guiding edge to allow the hook sliding into the hole for engaging the cover to the casing.

4. The storing lid for electronic devices of claim 1, wherein the lid has two opposite sides each has a bulged spot to retain the lid in the guiding channel when the lid is moved in the guiding channel towards the casing.

5. The storing lid for electronic devices of claim 4, wherein the extension plate has a latch slot corresponding to the bulged spot for latching the bulged spot when the lid is located on the first position.

6. The storing lid for electronic devices of claim 1, wherein the casing has a slot opening corresponding to the lid to house the lid when the lid is moved in the guiding channel towards the casing.

7. The storing lid for electronic devices of claim 1, wherein the extension plate has a strut extending outwards to restrict the turning angle of the lid about the stub shaft for the lid to be located on the first position.

* * * * *